US005125191A

United States Patent [19]

Rhoades

[11] Patent Number: 5,125,191

[45] Date of Patent: Jun. 30, 1992

[54] ABRASIVE FLOW MACHINING WITH AN IN SITU VISCOUS PLASTIC MEDIUM

[75] Inventor: Lawrence J. Rhoades, Pittsburgh, Pa.

[73] Assignee: Extrude Hone Corporation, Irwin, Pa.

[21] Appl. No.: 489,229

[22] Filed: Mar. 6, 1990

Related U.S. Application Data

[63] Continuation-in-part of Ser. No. 265,954, Nov. 2, 1988, abandoned, which is a continuation-in-part of Ser. No. 72,684, Jul. 13, 1987, abandoned, which is a continuation-in-part of Ser. No. 888,727, Jul. 24, 1986, abandoned, which is a continuation of Ser. No. 753,354, Jul. 16, 1985, abandoned, which is a continuation of Ser. No. 415,863, Sep. 8, 1982, abandoned.

[51] Int. Cl.[5] ..... B24B 31/00

[52] U.S. Cl. ..... 51/317; 51/2 R; 51/60; 51/7

[58] Field of Search ..... 51/60, 58, 2 R, 317, 51/310-312, 59 SS, 7, 16, 17, 26; 76/107.1

[56] References Cited

U.S. PATENT DOCUMENTS

| | | | |
|---|---|---|---|
| 3,521,412 | 7/1970 | McCarty | 51/317 |
| 3,593,410 | 7/1971 | Taylor | 51/317 |
| 3,708,919 | 1/1973 | Isaev et al. | 51/26 |

FOREIGN PATENT DOCUMENTS

| | | | |
|---|---|---|---|
| 0209755 | 11/1984 | Japan | 51/289 R |
| 0818841 | 4/1981 | U.S.S.R. | 51/319 |
| 1104006 | 7/1984 | U.S.S.R. . | |

*Primary Examiner*—Robert A. Rose
*Attorney, Agent, or Firm*—Waldron & Associates

[57] ABSTRACT

A workpiece surface is worked by placing a displacer member adjacent thereto sufficient to create a closed chamber therebetween into which a visco-elastic abrasive medium is deposited. A relative motion is then created between the workpiece and displacer causing the visco-elastic abrasive medium to move about within said chamber sufficient to have a translational movement along the surface of the workpiece thereby working the workpiece surface.

15 Claims, 5 Drawing Sheets

ABRASIVE FLOW MACHINING WITH AN IN SITU VISCOUS PLASTIC MEDIUM

BACKGROUND OFF THE INVENTION

1. Related Applications

This is a Continuation-in-Part of Application Ser. No. 265,954, filed Nov. 2, 1988, now abandoned, which was a Continuation-in-Part of Application Ser. No. 072,684, filed Jul. 13, 1987, now abandoned, which was a Continuation-in-Part of Application Ser. No. 888,727, filed Jul. 24, 1986, now abandoned, which was a Continuation of Application Ser. No. 753,354 filed Jul. 16, 1985, now abandoned, which was a Continuation of Application Ser. No. 415,863, filed Sep. 8, 1982, now abandoned.

2. Field of the Invention

This invention relates generally to a new and improved method of honing, polishing, reducing, or otherwise abrading workpiece edges and surfaces, and more particularly relates to a unique new process for working the surfaces of a workpiece utilizing a visco-elastic abrasive medium in situ between the workpiece and a displacer. One or more forms of relative motion between the workpiece and displacer is utilized to force the flow of the abrasive medium across the workpiece surface or surfaces to be worked thereby effecting the abrasion as desired.

3. Summary of the prior art

Abrasive flow machining is a well known nontraditional machining process whereby a visco-elastic medium, permeated with an abrasive grit, is extruded through or past a workpiece surface to effect an abrasive working of that surface. The abrasive action in abrasive flow machining can be thought of as analogous to a filing, grinding, lapping or honing operation where the extruded visco-elastic abrasive medium passes through or past the workpiece as a "plug." The plug then becomes a self forming file, grinding stone or lap as it is extruded under pressure through the confined passageway restricting its flow, thereby working the selected surfaces of the workpiece.

While abrasive flow machining is somewhat similar to other abrasion techniques wherein fluids are used as a medium to carry an abrasive grit in suspension for similar abrasion treatments, such as hydrodynamic machining, there are considerable differences. In applications where fluids are used, i.e. liquids or gases, very high velocities must be used in order to effect any abrasive action, because high speed impingement of the grit particles against the surface to be abraded is the essential force in such processes. In the present invention, as in other abrasive flow machining processes, the visco-elastic abrasive medium is a semi-solid plastic extruded through the restrictive passageway under considerable pressure but with a relatively low velocity. The semi-solid plastic medium must not only maintain the abrasive particles in a uniform suspension, but it must further provide a relatively firm backing for the abrasive grit to hold the grit firmly against the passageway surfaces while the semi-solid, visco-elastic medium and grit are extruded through or past the workpiece. Hence, rather than impinging at high speeds against the surface to be abraded, the grit is slowly and actively worked in a parallel path along the workpiece surface to be abraded. Unlike more conventional abrading techniques where the abrasive particles are held against the workpiece by a solid base support, however, the media supporting the abrasive particles is plastic nevertheless, so that a more uniform and smoother abrading action is effected.

The prior art apparatus utilized in abrasive flow machining, consists of a structure holding two directly opposed media chambers with the workpiece insertable therebetween. The media chambers are plastic extruding, positive displacement, expandable chambers which can hydraulically or mechanically extrude abrading media from one media chamber through the passageway of the workpiece and then into the other. A removable workpiece fixture, designed to hold the workpiece, is secured between the two media chambers. The workpiece fixture must be designed to securely hold the workpiece such that the workpiece surface to be worked is exposed within the passageway between the two media chambers. If a surface to be abraded is merely a bore through the workpiece, the fixture must serve to merely seal each end of the bore to a media chamber so that the bore itself becomes a sealed passageway between one media chamber and the other. On the other hand, if the workpiece surface to be abraded is an external surface, the fixture is usually more complex and must be designed so that the workpiece and fixture together define the essential restricted passageway so that the surface to be abraded forms a portion of the passageway, and the medium will abrade at least that surface as it is extruded through the passageway.

The extruding medium, consisting of a semisolid, difficulty flowable, visco-elastic material permeated with an abrasive grit, is contained in one of the media chambers, while the other chamber is empty. To perform the process, the abrasive medium is then extruded, hydraulically or mechanically, from the filled chamber to the empty chamber via the restricted passageway through or past the workpiece surface to be abraded, thereby working the surface as desired. Typically, the extruding medium is then extruded back and forth between the two media chambers to the extent necessary to effect the degree of abrasion desired. Counterbores, recessed areas and even blind cavities can be abraded by using restrictors or mandrils to direct and guide the abrasive medium flow along the surfaces to be abraded. A more detailed description of the basic prior art on abrasive flow machining can be found in U.S. Pat. Nos. 3,521,412, 3,634,973, McCarty; U.S. Pat. No. 3,802,128, Minear, Jr.; and U.S. Pat. No. 3,819,343, Rhoades.

Subsequent to the development to the basic abrasive flow machining process, numerous modifications have been developed which renders the process applicable to particular applications. While such prior art techniques of abrasive flow machining are very effective, particularly in the machining of surfaces within confined passageways or surfaces which can easily be incorporated within a confined passageway with a proper fixture, they do have their limitations, particularly in the machining of large and complex surfaces such as the internal surfaces of large mold cavities, and the outer surfaces of gear wheels and the like, where it is difficult, if not impossible, to effect a uniform medium flow accross the entire surface to be worked. If large surface areas are involved, the volume of the visco-elastic abrasive medium becomes rather excessive, requiring larger equipment with an attendant larger expense and considerable difficulty is setting-up the workpiece in a fixture to be so machined or otherwise abraded.

SUMMARY AND OBJECTS OF THE INVENTION

This invention is predicated upon the development of a new controlled and automatic method for the working of workpiece edges and surfaces with a visco-elastic abrasive medium which does not involve the direct extrusion thereof, and is particularly useful in the working of large complex edges and surfaces such as injection mold cavities, forging dies, gear wheels, turbine disks and the like. In this inventive process, a medium displacement chamber is formed between the workpiece to be machined and a displacer, which may be similar to a mandril or restrictor as utilized in the prior art. The displacer member is shaped to have surfaces in a facing spaced relationship to the surfaces and/or edge of said workpiece to be abraded to thereby form a closed media chamber between the surfaces of said workpiece to be machined and said displacer member. Instead of directly extruding the visco-elastic abrasive medium through the chamber, however, the chamber is completely filled with a mass of the abrasive medium and is preferably sealed therein. Then the displacer and/or workpiece are put into relative motion so that the in situ abrasive medium is forced to move about within the media chamber, i.e. extruded from one area of the chamber to another, so that its motion across the surface of the workpiece will machine or otherwise abrade the surface as it moves therepast.

As in conventional abrasive flow machining, the visco-elastic abrasive medium is ideally a rheopectic material having the consistency of putty at room temperature with no pressure applied. In the context of this invention, "rheopectic" defines the property of a composition in which the viscosity increases with time under shear or a suddenly applied stress. Stated another way, this property of the abrasive media is exactly the opposite of "thixotropy". A typical example of such a material is silicone bouncing putty (borosiloxane). Accordingly, the visco-elastic abrasive medium is extruded, i.e. displaced positively across a portion of a workpiece which is utilized as the displacement chamber or as the displacer, or as both. In this context, the abrasive medium acts as a positively displaced abrading tool.

In addition to the above, it has been learned that products worked in accordance with this invention, will have an induced compressive residual stress at the worked surfaces. Accordingly, the process of this invention can be utilazed not only to work selected surfaces thereof to finish the surfaces as desired, but also to induce compressive residual stress within such surfaces. This characteristic of the process may serve to eliminate additional processing, such as shot peaning, where inducement of such compressive residual stresses is required.

Accordingly, it is an object of this invention to provide a new controlled and automatic process for honing, polishing, reducing or otherwise working a workpiece surface or edge utilizing a visco-elastic abrading medium.

Another object of this invention to provide a new controlled and automatic process for honing, polishing, reducing or otherwise working a workpiece surface or edge utilizing a visco-elastic abrading medium which does not involve the direct extrusion of the abrasive medium.

Still another object of this invention is to provide a new controlled and automatic process for honing. polishing. reducing or otherwise working a workpiece surface or edge which is ideally suited to the working of surface areas not easily worked by conventional abrasive flow machining.

A further object of this invention is to provide a new controlled and automatic process for honing, polishing, reducing or otherwise working a workpiece surface or edge which will induce a compressive residual stress within the worked surface.

DETAILED DESCRIPTION OF THE INVENTION

Throughout the description of the invention, the term "relative" motion or movement between the opposed surfaces is used to indicate that either or both the workpiece and displacer may be in motion to accomplish positive displacement of the viscous abrasive medium throughout the chamber. Further, this movement may be linear, gyratory, orbital, reciprocal, or any other motion or any combination thereof with or without the combination of rotary motion therewith, as long as the relative motion effects a positive translational flow and displacement of the abrasive medium across the workpiece surface to be worked.

Figure 1:
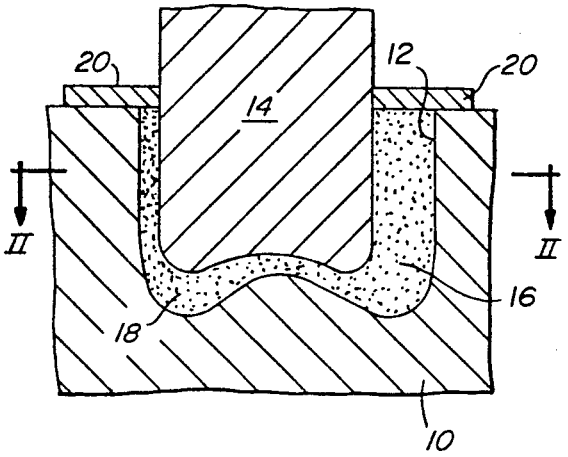
FIG. 1 is a cross-sectional side view illustrating one embodiment of this invention which involves orbital or horizontal reciprocal relative motion or combinations thereof between the displacer and workpiece.
Figure 2:
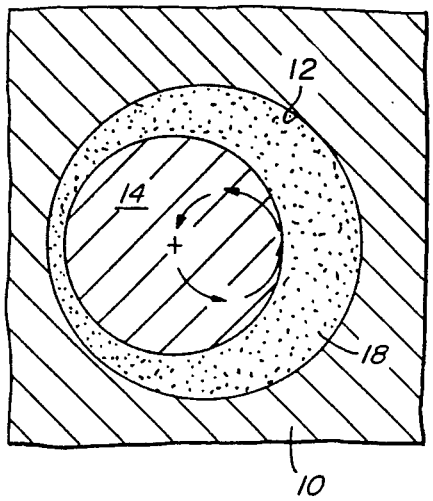
FIG. 2 is a cross-sectional top view of the embodiment shown in FIG. 1 with the section taken at line II—II, and depicts an embodiment utilizing orbital relative movement, with or without rotational movement.

Reference to FIGS. 1 and 2 will illustrate one embodiment of this invention in its simplest form utilizing only an orbital relative motion, wherein workpiece 10 could be a die casting mold or the like having a mold cavity 12 therein to be abraded. A displacer 14, having a profile smaller than cavity 12, is adapted to be insertable within cavity 12 to provide a medium chamber 16 formed between the entire surface of cavity 12 and displacer 14. A visco-elastic abrasive medium 18 is deposited within medium chamber 16, and is sealed therein by sealing ring 20, securely attached around displacer 14, when displacer 14 is properly inserted within cavity 12, as shown. With displacer 14 and sealing ring 20 held in this fixed vertical position relative to the workpiece 10, a relative orbital motion is effected between workpiece 10 and displacer 14. During the relative orbital motion the total volume of chamber 16 will remain constant, but the volume of any given portions thereof will constantly be changing, with such partial volumes repeatedly increase and decrease with each orbital revolution. Accordingly, the relative orbital motion between workpiece 10 and displacer 14 will cause a continuing translational motion of the abrasive medium 18 as it circulates from areas of decreasing volume to areas of increasing volume, and progressively recirculated throughout the media chamber. Accordingly, there will also be a continuing translational displacement of the abrasive medium 18 across the contacting surfaces of workpiece 10 and displacer 14, thereby causing the surface of the cavity 12 to be abraded as desired. The relative orbital motion is continued, repeatedly circulating the abrasive medium 18 within the media chamber 16, until the cavity surface 12 is abraded to the extent desired.

With reference to FIG. 2, the arrows forming a circle passing over displacer 14 are presented to show the orbital path of the axis of displacer 14 in the application of this embodiment as described above. The motion of the visco-elastic abrasive medium 18 is essentially the same, and necessarily results as it is squeezed from an area of chamber 18 which is diminishing in volume to an area that is expanding in volume. In this embodiment, the relative orbital motion can be combined with a relative rotational motion so that in essence, with respect to the workpiece 10, the displacer 14 rotates on its axis at the same time as it orbits within cavity 12. This combined motion will serve to enhance the translational movement of the abrasive medium 18 across the surfaces of both the cavity 12 and the displacer 14.

With regard to the bottom of cavity 12, it should be apparent that if it is a flat surface, and the base of displacer 14 is also flat, there would be comparatively less translational motion of the abrasive medium 18 across these surfaces if only an orbital relative motion in utilized, since there is no change in cavity volume in this area, particularly in the central portion thereof. The bottom of the displacer would be subjected to some motion of the abrasive medium which would have a tendency to work on the corner intersection of the cylindrical side and flat bottom surfaces. In this event, the addition of a rotational relative motion in combination with an orbital relative motion, as noted above, would offer considerable advantage by enhancing the translational motion of the abrasive medium across the flat bottom surfaces to thereby enhance the working of these two surfaces. In the two bottom surfaces as specifically depicted, however, the surfaces are not flat, but rather are slightly domed. As shown, therefor, there is some degree of changing volume of chamber 18 adjacent to the bottom surfaces, so that there will be a squeezing or extrusion of the abrasive medium 18 across these bottom surfaces to work the surfaces, even if only a relative orbital motion is imposed. The addition of a rotational relative motion may be necessary, however, to enhance the translational motion of the abrasive medium in this area as may be necessary to effect the degree of working desired.

In the embodiment described above, it should be apparent that the visco-elastic abrasive medium 18 will exhibit a translational movement along the outer cylindrical surface of displacer 14 as well as the workpiece surface of cavity 12. Accordingly, either piece, 10 or 14, could be representative of the workpiece as well as the displacer. It follows therefore, that FIGS. 1 and 2 could be representative of an embodiment whereby the peripheral surfaces of a cylindrical workpiece are abraded by utilizing the walls of cavity 12 as the displacer.

Figure 3:
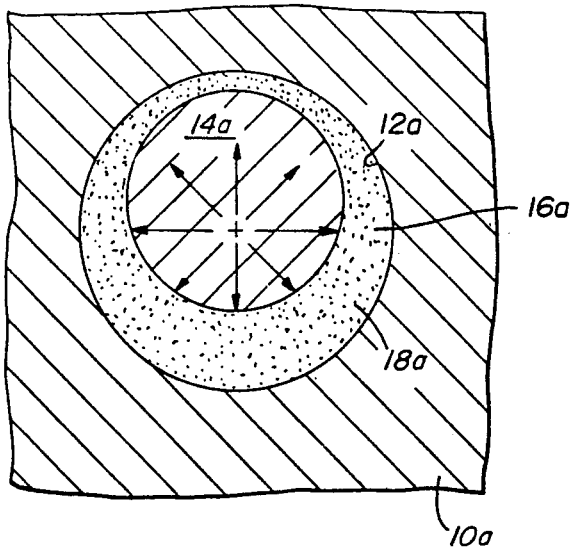
FIG. 3 is identical to FIG. 2 except that it depicts an embodiment utilizing a lateral reciprocal motion in several planes of movement, again with or without rotational motion.

The embodiment depicted in FIG. 3 is substantially like that depicted in FIG. 2 described above, except that there is a relative lateral oscillatory motion between the displacer 12*a* and the workpiece 10*a*, here again with or without rotational motion. In this embodiment, the visco-elastic abrasive medium 18*a* is forced to flow back and forth within the chamber 16*a* by the relative lateral oscillatory motion, which can be in any one, two or more planes as represented by the arrows imposed over the displacer 14*a*. It should be apparent, however, that if the lateral relative motion were in only one plane of motion, that the translational motion of the media 18*a* would not be uniform, but rather would be maximized at those surfaces more closely parallel to the plane of relative motion and minimized at surfaces more closely perpendicular to the plane of motion. By utilizing at least two perpendicular planes of relative motion, this nonuniformity of translational motion of the abrasive medium can be avoided. On the other hand, this nonuniformity can be used to advantage in some applications where nonuniformity in the abrasion action is desired.

In the two embodiments described above, it should be apparent that the form of relative movement between the displacer and the workpiece is not particularly critical, particularly where the surface of the workpiece is uniform and continuous as shown. Indeed, the orbital or reciprocal motions as depicted in these two embodiments will have comparable abrading effects on the workpiece, provided, of course, that the lateral motion depicted in FIG. 3 is effected in at least two perpendicular planes of motion.

Figure 5:
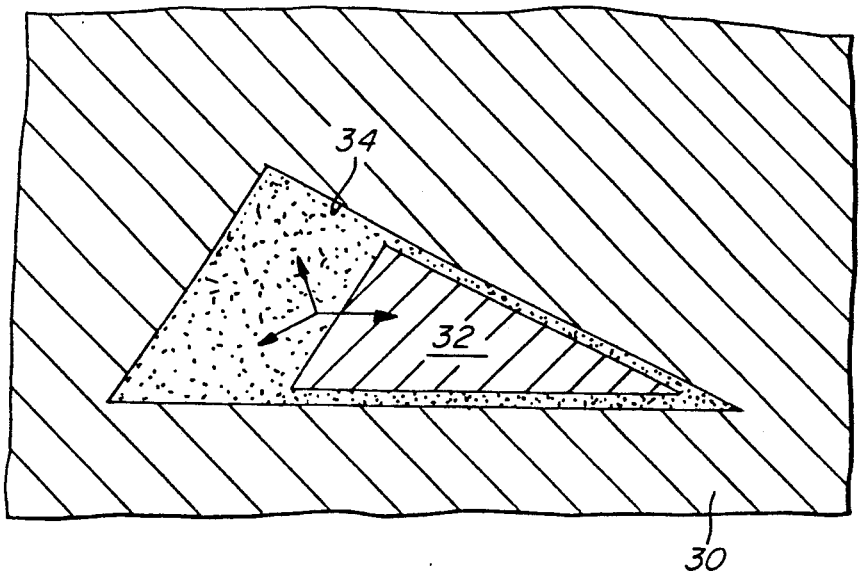
FIG. 5 is a cross-sectional top view illustrating another embodiment of this invention which involves only a triangular orbital relative movement between the displacer and workpiece.
Figure 4:
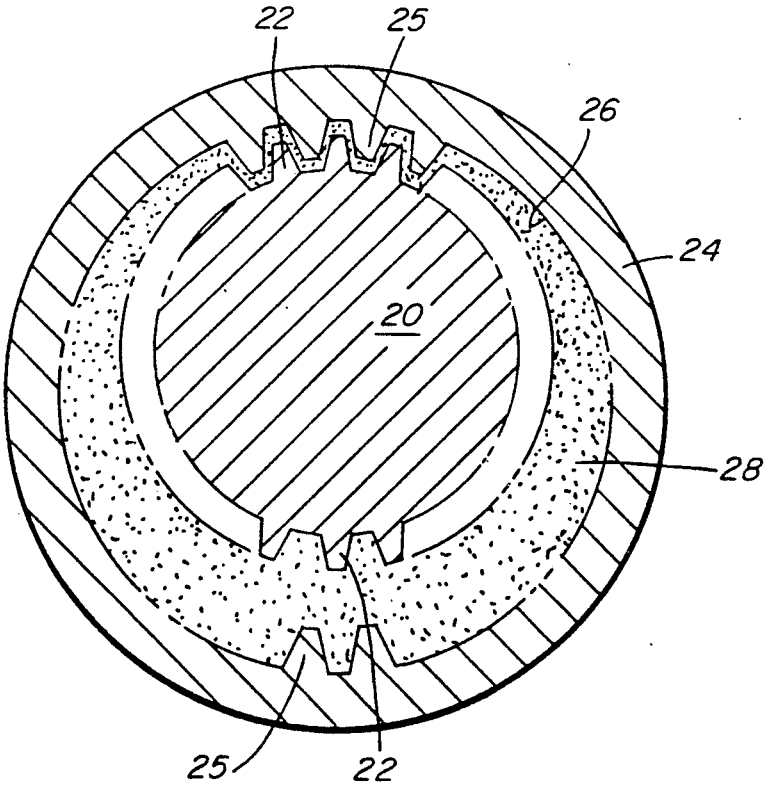
FIG. 4 is cross-sectional top views of another embodiment of this invention, in this case where the workpiece is a gear, and utilizes both rotational and orbital relative movement between the workpiece and displacer.

In the embodiment shown in FIG. 4 the principal of the application is the same except that a more complex workpiece surface is to be worked. As shown in FIG. 5, the workpiece 20 may be a gear wheel or the like having uniformly spaced gear-teeth 22 around the cylindrical periphery. The displacer 24 is an annular shaped body which is positioned to encircle workpiece 20, providing an annular chamber 26 therebetween. Displacer 24 is preferably provided with a plurality of protrusions 25 extending inwardly, and having a size and spacing as can be insertable between gear-teeth 22. When a visco-elastic abrasive medium 28 is sealed within chamber 26, a relative motion is imparted between workpiece 20 and displacer 24. In this embodiment, the relative motion between the workpiece 20 and displacer 24 is a combination of rotational and orbital motion so that the gear-teeth 22 will come close to meshing with protrusions 25 as workpiece 20 rotates and orbits, i.e. "rolls" around and along the inner surface of displacer 24, but leaving a small gap so that the two components do not in fact come into contact, or bridge any abrasive particles therebetween. Accordingly, the abrasive medium 28 will not only be forced to revolve about chamber 26 in a manner similar to that described above, but the near meshing of gear-teeth 22 into protrusions 25 will cause the abrasive medium to flow into and out of the spaces between the gear teeth 22 so that it will be forced to flow along the surface of gear-teeth 22 to abrade the surface thereof as desired. While a smooth surface on displacer 24 could be provided, it should be readily apparent that medium 28 would not be squeezed from the recesses between gear-teeth 22, so that the abrasion would be concentrated on the outer periphery of gear teeth 22, with little or no abrasion on the inner surfaces.

In the embodiment illustrated in FIG. 5, a three dimensional machining action is exemplified. Here, the workpiece 30 has a triangular opening therethrough to be machined. A mating but substantially smaller triangular displacer 32 is positioned within the triangular opening in workpiece 30, having sufficiently smaller dimensions so that there is sufficient space between the triangular opening and the displacer 32 to form a three-sided medium chamber 34 therearound. The workpiece 30 and/or the displacer 32 are mounted to a suitable means (not shown) as will impart a relative triangular translational motion between the workpiece 30 and displacer 32 as depicted by the arrow over displacer 32 so that the corners of the displacer 32 will move into the corners of the workpiece 30. As already described, a visco-elastic abrasive medium is deposited within the media chamber 34 and sealed therein before the triangular orbital motion is started. When the motion is started, the abrasive medium is forced to flow within the three-sided medium chamber as it is squeezed and extruded from between two opposing surfaces which are coming together and into the space between two opposing surfaces that are moving apart.

Figure 7:
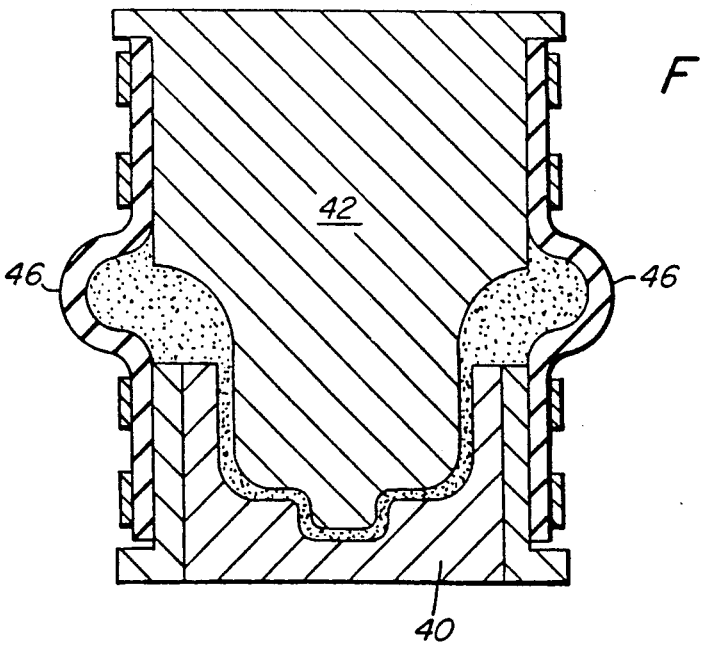
FIG. 7 is identical to FIG. 6 except that it illustrates the displacer in the fully inserted position.
Figure 8:
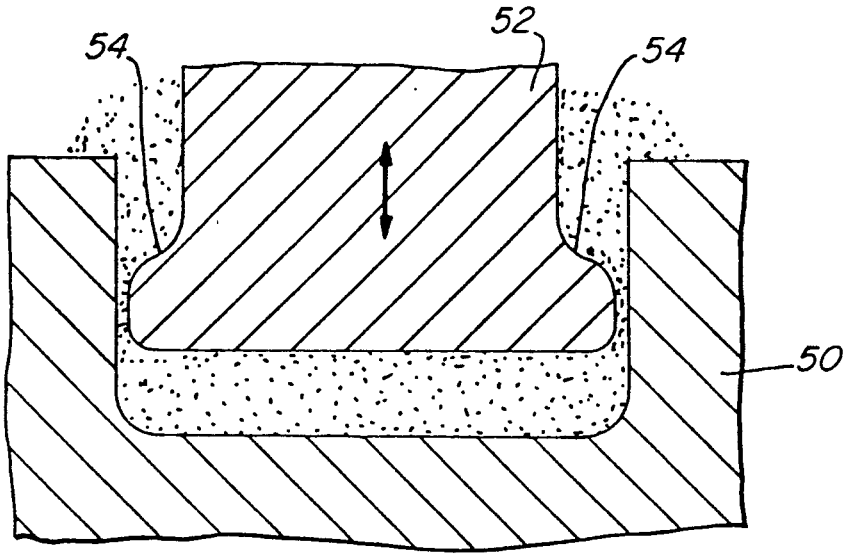
FIG. 8 is a cross-sectional side view illustrating another embodiment of this invention involving a vertical relative reciprocal motion as utilized to effect a more even abrasion of the workpiece.

In the embodiment illustrated in FIGS. 7 and 8, the principle of the abrasion action is substantially the same, except that there is a vertical reciprocal relative motion between the workpiece 40 and the displacer 42, such that the visco-elastic abrasive medium is virtually squeezed out of the media chamber 44 with each downward movement of the displacer 42. In the embodiment as illustrated, an elastic sleeve member 46, such as a length of heavy rubber pipe, is secured around the upper periphery of workpiece 40 and the lower periphery of displacer 42, and there held by clamps 48. As shown in FIG. 7, the arrangement is in its starting position with the displacer 42 in a fully upward or retracted position with most of the visco-elastic abrasive medium disposed within the media chamber 44 such that the sides of media chamber are closed by the resilient sleeve member 46. As the displacer 42 commences its downward relative motion into the cavity of workpiece 40, the visco-elastic abrasive medium is squeezed or extruded from the cavity or media chamber 44 moving upward between the vertical surfaces of workpiece 40 and displacer 42 thereby abrading the vertical surfaces of workpiece 40. Since the visco-elastic abrasive medium has no place to go as the media chamber 44 becomes progressively smaller, the pressure of the abrasive medium forces the sides of elastic sleeve member 46 to be stretched outward to take up the excess volume of the visco-elastic abrasive medium, as illustrated in FIG. 8. Subsequently, when the displacer 42 starts its upward relative motion, elastic sleeve member 46 will force the visco-elastic abrasive medium back into the expanding media chamber 44, with the system eventually returning to that as illustrated in FIG. 7. This cycle is repeated each time the displacer 42 reciprocates.

Figure 9:
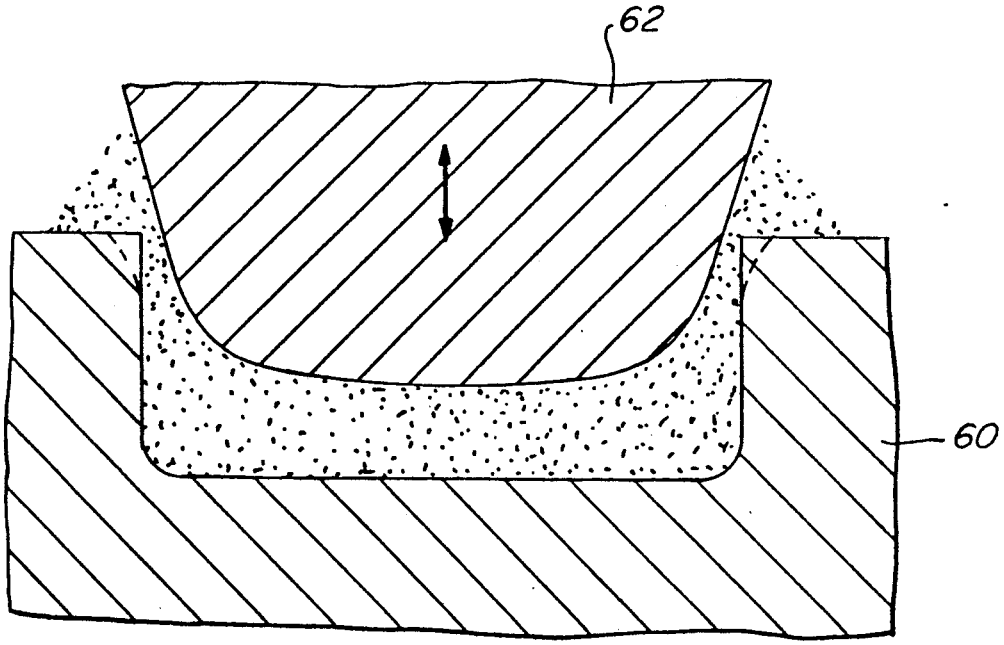
FIG. 9 is a cross-sectional side view illustrating another embodiment of this invention involving a vertical relative reciprocal motion as utilized to effect an uneven abrasion of the workpiece.

In the vertically reciprocating embodiment described above, it should be apparent that there will be some degree of uneven abrasive action on the workpiece 40 and the displacer 42, since there will be progressively a greater translational motion of the abrasive medium along the upper vertical surfaces of the workpiece 40, and lower vertical surfaces of the displacer 42, than there will be at the opposite surfaces or along the horizontal surfaces. This result should be obvious because the upper portion of the vertical cavity walls will be abraded as soon as the displacer moves downward adjacent thereto and will continue to be abraded as the displacer continues to move downward. The lower portion of those cavity walls, however, will not be significantly abraded until the displacer moves adjacent thereto. Such an uneven abrasive action can be utilized to an advantage in some applications, such as the finishing of mold cavities and other workpieces, where some degree of taper is essential. This characteristic can be either minimized or enhanced by the proper design of the displacer to workpiece interface. As an example thereof, FIG. 8 represents a displacer design as will minimize uneven abrasion, while FIG. 9 illustrates a design as utilized to maximize uneven abrasion to the extent of radiusing the upper corner of the cavity in the workpiece. With reference to FIG. 8, it can be seen that displacer 52 is provided with heavy collar or flange portion 54 around the lower extremity thereof. Accordingly, as displacer 52 moves downward within workpiece 50 and extrudes the visco-elastic abrasive medium upward along the side wall of workpiece 50, the translational motion of the abrasive medium will be concentrated in the narrowed volume of the chamber adjacent to the flange 54. Above the flange 54, where the spacing between workpiece 50 and displacer 52 is considerably increased, the motion of the abrasive medium is practically nil, and the abrasive action on the workpiece side wall is virtually nonexistent. It follows, therefore, the concentration of heavy abrasion adjacent to the flange 54 is uniform throughout the full travel length of the flange 54, so that the bottom portion of the workpiece is abraded as much as the upper portion. As previously suggested, the addition of a rotational relative motion to the reciprocal relative motion, will serve to enhance the translational motion of the abrasive medium across the base of the chamber to enhance abrasion of the base surface of the workpiece.

FIG. 9 illustrates a reverse situation to that described immediately above, where the displacer 62 is designed to maximize abrasion at the upper edge of the cavity surface in workpiece 60 to effect a radiusing thereof. Because the entire side surface of displacer 62 is angled with respect to the side surface of the cavity within workpiece 60, the abrasive action of the visco-elastic abrasive medium will be concentrated at that area where its passage is most restricted, in this case the upper edge of the cavity. The solid line is representative of the starting surface of the cavity side wall, while the dotted line is representative of the form of the finished cavity side wall.

In addition to the above discussed variations in the design of the workpiece-displacer interface, there are numerous other concepts that could be utilized to effect differing abrasion requirements. Here too, differing forms of motion in combination with vertical reciprocal motion could be utilized to effect differing abrasion requirements. In addition to combining a orbital, or horizontal reciprocal motion with the vertical reciprocal motion, the angle of the vertical reciprocal motion can be varied so that it moves downward at an angle into the workpiece to be abraded, or the angle can be slowly rotated so that the displacer moves downward into the workpiece at a constantly changing angle. This type of relative motion is illustrated in FIG. 9, where the displacer is shown to be of the reciprocating type in a fully inserted position at one side of the cavity being abraded. The dotted line represents the position of the displacer at an angled position at a subsequent point in the process. The change in the angle of reciprocation is apparent. Accordingly, the variations seem almost countless, and are limited only by one's imagination to formulate new variations of motion and displacer design to satisfy a great variety of abrading requirements.

Figure 10:
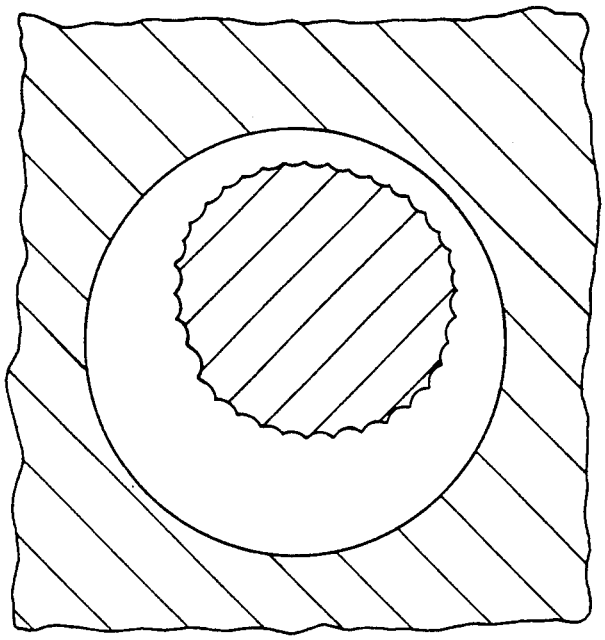
FIG. 10 is a cross-sectional side view identical to FIG. 2 except that it illustrates a displacer having an irregular surface or fins thereon to resist the flow of abrasuve medium therepast.
Figure 11:
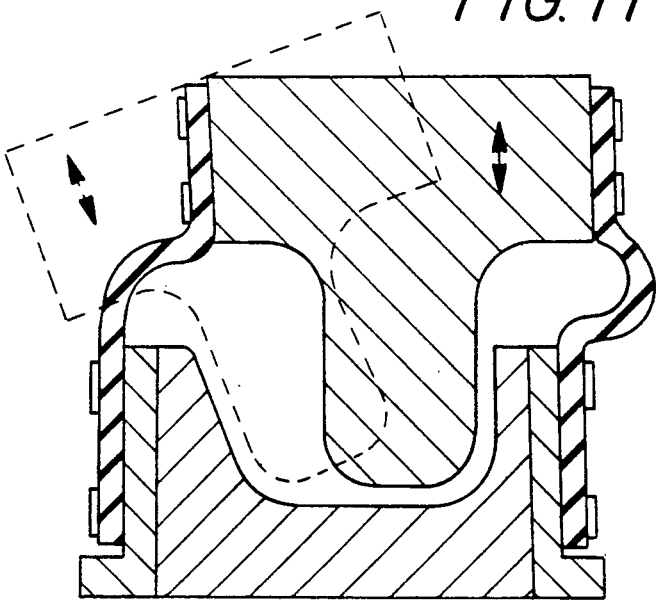
FIG. 11 is a cross-sectional view similar to that shown in FIGS. 6 and 7 except that it illustrates a changing axis of vertical reciprocation.

In most applications it is of course desired that the surfaces of the workpiece be abraded while abrasion of the displacer be minimized to the maximum extent possible. In a more practical application of the above described embodiments the efficiency of the operation can be improved and wear of the displacer surface minimized if the surface of the displacer is such that it is resistant to the flow of the visco-elastic abrasive medium therepast. This can readily be done by any of several ways. For example, fin-like protrusions can be incorporated on the surface of the displacer which will project into the body of abrasive medium so that the medium is more or less carried along with the motion of the displacer and the relative displacement between the displacer and the abrasive medium is reduced while enhancing the relative translational motion between the abrasive medium and the workpiece. Such a displacer is illustrated in FIG. 10. It is also known that the medium will tend to adhere to porous or roughened surfaces as well as certain matrials such as silicon rubber or like materials. Accordingly, if the surface of the displacer is made porous or roughened, or is coated with silicon rubber or a comparable material, the medium will tend to adhere thereto, so that when there is relative movement between such a displacer and a workpiece surface, the translational motion of the abrasive medium is enhanced adjacent to the workpiece surface at the expense of translational motion adjacent to the displacer. It should be appreciated, however, that since there is no registration or exacting mating of the displacer surface to the workpiece surface, wear at the displacer surface can be tolerated without significantly effecting the process or results.

As noted, the desired abrading action is effected by the translational motion of the abrasive media being extruded across the surface of the workpiece, with the abrasive particles supported only by the viscous nature of the visco-elastic medium. Clearly, therefore, the minimum permissible gap distance between the workpiece surface and the displacer surface must be greater than the maximum dimension of the abrasive particles so that no abrasive particles can "bridge" the gap between the workpiece and displacer. While any such bridging would not interfere with the desired abrasion action when the workpiece and displacer surfaces are moving apart, such bridging would cause a localized disruption of the translational motion of the abrasive medium. More importantly, however, such bridging action will cause the physical impingement and driving of the abrasive particles into and across the workpiece surface thereby scratching, gouging and damaging the otherwise comparatively smooth and uniform working of the workpiece surface as effected by abrasive flow machining.

Figure 6:
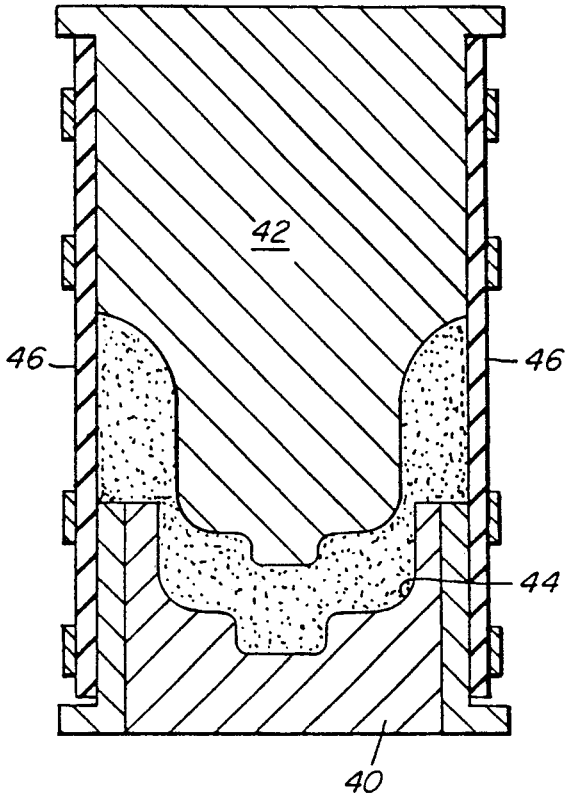
FIG. 6 is a cross sectional side view illustrating another embodiment of this invention which involves a vertical relative reciprocal motion between the workpiece and displacer. As illustrated, the displacer is in the fully withdrawn position.

Typical parameter ranges for the embodiments illustrated would include grit sizes of 6 microns to 16 mesh, gap distance of 0.002–0.500 inches, time treatments of 5–60 minutes, revolutions, orbits or vibrations of 20 to 20,000 per minute, and amplitudes of vibration of 0.025–0.500 inches. As an example, after substantially filling the gap with a visco-elastic abrasive medium in the embodiment illustrated in FIG. 6, the displacer can be operated at 500 vibrations per minute with an amplitude of 0.05 inches for 5 minutes and a gap of 0.005 inches with a grit size of 10 microns.

It is preferable that the plastic carrier matrix have a sufficient body at moderate pressure and low velocity to hold the abrasive particles against the work surface with sufficient force to produce the results desired. One mixture successfully used in the invention is MV70 Extrude-Hone media, comprising 50% by volume of silicon carbide abrasive grit and 50% by volume of silicone bouncing putty (borosiloxane) carrier (matrix) having a ratio of approximately 2:1 by weight.

By definition, silicone bouncing putty (borosiloxane) exhibits many of the characteristics of a fluid. However, under stress it becomes less flowable and more like a solid. It conforms exactly to the shape of whatever confines it and this helps in abrading intricate shapes and details. It should be noted that silicone bouncing putty (borosiloxane) is particularly useful in the invention as it is well known that this material becomes harder when subjected to sudden shear force such as when squeezed in the gap between the opposed surfaces as they are moved relative to one another. This increased stiffness enhances abrasion of the workpiece by holding the abrasive particles more firmly in place and transferring the driving force of the working member to the abrasive grains at the work surface. This holding action, however, is not a direct physical binding as in the case of conventional abrading techniques utilizing a solid base support, so that the abrasive action is smoother and more uniform.

A non-rheopectic abrasive medium suitable for use in some situations is that described in U.S. Pat. No. 3,819,343, Rhoades.

This invention may be utilized to hone or abrade machined parts, die castings, forgings, sand castings, investment castings and extruded shapes as well as other products. It is applicable to all materials such as steel, aluminum, brass, bronze, plastics, glass and other compositions and materials as needed.

Obviously, the abrasive used in the carrier matrix will be varied to suit the job. A satisfactory abrasive to use in working on steel is boron carbide (BC) which is readily obtained from the Norton Company in standard grit sizes. Another abrasive which is useful for many applications is aluminum oxide. Other abrasives might include diamond dust silicon carbide, rouge, corundum, garnet, aluminum, glass or, in some unusual operations, softer material such as fiber or shell material. Commonly, the abrasive will vary from about 2 to 4 pounds of abrasive particles per pound of the matrix material.

The above-mentioned visco-elastic honing media act as a surface abrading tool and are unique for the reason that the abrasive grit is held or contained in a random repositioning arrangement in a plastic matrix. The grain particles in use in the process of this invention are sharp until the sum of all points or edges have been exposed many times, as opposed to the traditional concept of an abrasive "stone" or lap wherein the grain particle is fixed and presents one cutting point or edge which is maintained until dulling causes removal by means of a dressing operation.

The fastest cutting action, which is also consistent with the most uniform results, occurs when the abrasive medium exhibits an oily non-adhering contact with the work surface. It would appear that when in this condition the abrasive medium has the greatest opportunity to pass through the gap at a constant cross-sectional pace. This is contrary to a fluid flow which is greatest through the center and supposedly "zero" along the wall.

It should be apparent from the above described embodiments of this invention that there are many possible variations that could be utilized to effect many differing abrading requirements. Accordingly, the present invention is not limited to the preferred embodiments disclosed herein, and that many modifications in construction, arrangement, use and operation are possible within the true spirit of the invention. Accordingly, the present invention is to be considered as including all such modifications and variations coming within the scope of the appended claims.

What is claimed is:

1. A method of treating a workpiece to work selected surfaces and edges thereof, comprising the steps of:

providing a displacer member adjacent to said workpiece, said displacer member having surfaces in a facing, spaced relationship substantially conforming to the surfaces of said workpiece to be abraded to thereby form a media chamber between the surfaces of said workpiece to be worked and said displacer member;

introducing an abrasive medium into said media chamber, said abrasive medium comprising a visco-elastic material containing abrasive particles;

imparting a relative motion between said workpiece and said displacer member sufficient to cause at least a portion of said abrasive medium to be extruded from one part of said media chamber to another with a positive translational displacement with respect to said displacer member and said workpiece to thereby work said selected workpiece surfaces, said relative motion between the workpiece and displacer being such that the minimum spacing between said displacer member and said workpiece is greater than the maximum dimension of said abrasive particles thereby preventing bridging of any abrasive particles between said displacer member and said workpiece; and continuing said motion until said selected workpiece surfaces are worked to the extent desired.

2. The method of claim 1 wherein said abrasive medium is sealed within said media chamber.

3. The method of claim 1 wherein said relative motion is an orbital motion.

4. The method of claim 1 wherein said relative motion is an oscillatory motion.

5. The method of claim 1 wherein said relative motion is a reciprocal motion.

6. The method of claim 1 wherein said relative motion is a linear motion.

7. The method of claim 1 wherein said relative motion is a gyratory motion.

8. The method of claim 1 wherein said relative motion is a combination of motions.

9. The method of claim 4 further comprising the step of varying the angle of the axis of reciprocation relative to said surface to vary the positive work of said medium.

10. The method of claim 1 wherein said displacer is provided with a surface resistant to the flow of said abrasive medium therepast.

11. The method of claim 10 wherein said surface resistant to the flow of said abrasive medium is effected by providing a plurality of protrusions thereon.

12. The method of claim 10 wherein said surface resistant to flow of said abrasive medium is porous.

13. The method of claim 10 wherein said surface resistant to the flow of said abrasive medium is provided by applying a coating of a material to which the medium tends to stick.

14. The method of claim 10 wherein said surface resistant to the flow of said abrasive medium is provided by applying a coating of silicon rubber.

15. The method of claim 1 wherein said selected surfaces of the workpiece are worked for the purpose of inducing compressive residual stresses within said surfaces.

* * * * *